US007750761B2

(12) United States Patent
Chu

(10) Patent No.: US 7,750,761 B2
(45) Date of Patent: Jul. 6, 2010

(54) SIGNAL TRANSMISSION STRUCTURE

(75) Inventor: Cheng-Hui Chu, Taipei (TW)

(73) Assignee: Inventec Corporation, Taipei (TW)

( * ) Notice: Subject to any disclaimer, the term of this patent is extended or adjusted under 35 U.S.C. 154(b) by 154 days.

(21) Appl. No.: 12/211,372

(22) Filed: Sep. 16, 2008

(65) Prior Publication Data

US 2010/0007431 A1 Jan. 14, 2010

(30) Foreign Application Priority Data

Jul. 8, 2008 (TW) ..... 97125777 A

(51) Int. Cl.
*H01P 3/08* (2006.01)

(52) U.S. Cl. ..... 333/246; 333/238

(58) Field of Classification Search ..... 333/245, 333/246, 238, 33; 361/794, 780
See application file for complete search history.

(56) References Cited

U.S. PATENT DOCUMENTS 7,471,174 B2 * 12/2008 Hieda et al. ..... 333/246
2008/0042775 A1 * 2/2008 Yang et al. ..... 333/34

* cited by examiner

*Primary Examiner*—Stephen E Jones
(74) *Attorney, Agent, or Firm*—CKC & Partners Co., Ltd.

(57) ABSTRACT

A signal transmission structure includes two power planes, a signal line and a first pillar. The power planes spaced by an interval space provide a first voltage and a second voltage respectively. The signal line, disposed on first surfaces of the power planes, is disposed across the interval space. The first pillar is disposed within the interval space and is aside the signal line, in which the first pillar is apart from the power planes and the signal line.

15 Claims, 7 Drawing Sheets

SIGNAL TRANSMISSION STRUCTURE

RELATED APPLICATIONS

This application claims priority to Taiwan Application Serial Number 97125777, filed Jul. 8, 2008, which is herein incorporated by reference.

BACKGROUND

1. Field of Invention

The present invention relates to signal transmission structure. More particularly, the present invention relates to the transmission structure of high frequency signals.

2. Description of Related Art

Recently, the DSP's internal clock rate has reached GHz level and signal transmitting/receiving frequency is also up to more than 100 MHz. In such high-speed digital circuits, noise and electromagnetic interference (EMI) are critical problems. Unfortunately, digital signal processing (DSP) systems processing audio/video signals and communication signals are sensitive to these disturbances. For example, the high-speed switching signals, with a lot of noise and interference, affect the DSP system performance.

There are several sources which might cause the switching noise. The transmission line with reflection phenomena is one of them. To minimize the reflection phenomena caused by the high frequency transmitting, the length of the current return path is short as possible. Generally speaking, low-speed signals return to the signal source along the shortest path with minimum resistance, and high-speed signals return to the signal source along with the shortest path with minimum inductance. Therefore, the object of high-speed circuit is to provide the minimum inductance path. This can be achieved with the power supply plane and the ground plane. Power plane is an inherent high-frequency decoupling capacitor and is able to minimize parasitic inductance. The ground plane also known as the mirror plane has a shielding effect and provides the shortest current return path.

The existing digital circuit usually requires several power signals to provide different voltages. Therefore, the power plane is usually divided into several regions with slots to provide different voltages on different regions. Because current of the system needs to return to the current source, if there is discontinuation in the region of the system, such as the slot, current needs to go around to pass the discontinuous region, which increases the length of the current return path and the equivalent inductance. Thus, high-frequency signals might be filtered out due to the increased inductance, which causes signal distortion.

Hence there is a need for a new signal transmission structure that can reduce the high frequency signal loss caused by the slot on the power plane and keep the signal complete.

SUMMARY

According to one embodiment of the present invention, a signal transmission structure includes two power planes, a signal line and a first pillar. The power planes spaced by an interval space provide a first voltage and a second voltage respectively. The signal line, disposed on first surfaces of the power planes, is disposed across the interval space. The first pillar is disposed within the interval space and is next to the signal line, in which the first pillar is apart from the power planes and the signal line.

According to another embodiment of the present invention, a signal transmission structure includes a power plane, a slot, a signal line, a ground plane, and a first pillar. The slot is disposed on the power plane and divides the power plane into two regions to provide two power signals. The signal line is disposed on a first surface of the power plane and is across the slot. The ground plane faces a second surface of the power plane. The first pillar passes through the slot and is electrically connected to the ground plane, in which the first pillar is aside the power plane and apart from the signal line.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1A:
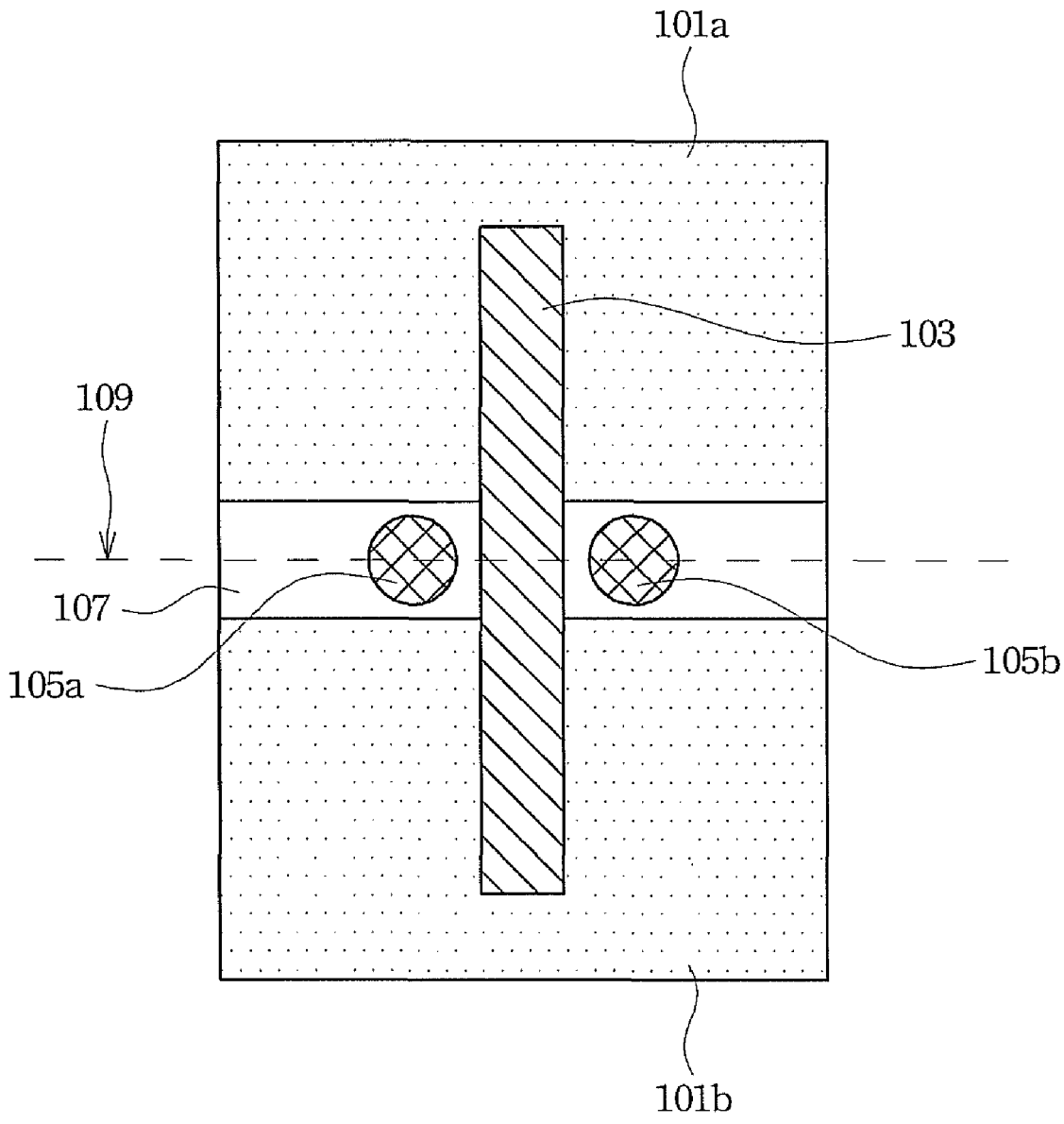
FIG. 1A, shows the top view of the signal transmission structure according to one embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

In the following embodiment, the pillar is disposed in the interval space between the power planes, and is electrically connected to the ground plane. The current return path can be shortened by the pillar, such that the effective inductance is reduced, and the high frequency signal loss is reduced, which maintains the signal as original.

Figure 1B:
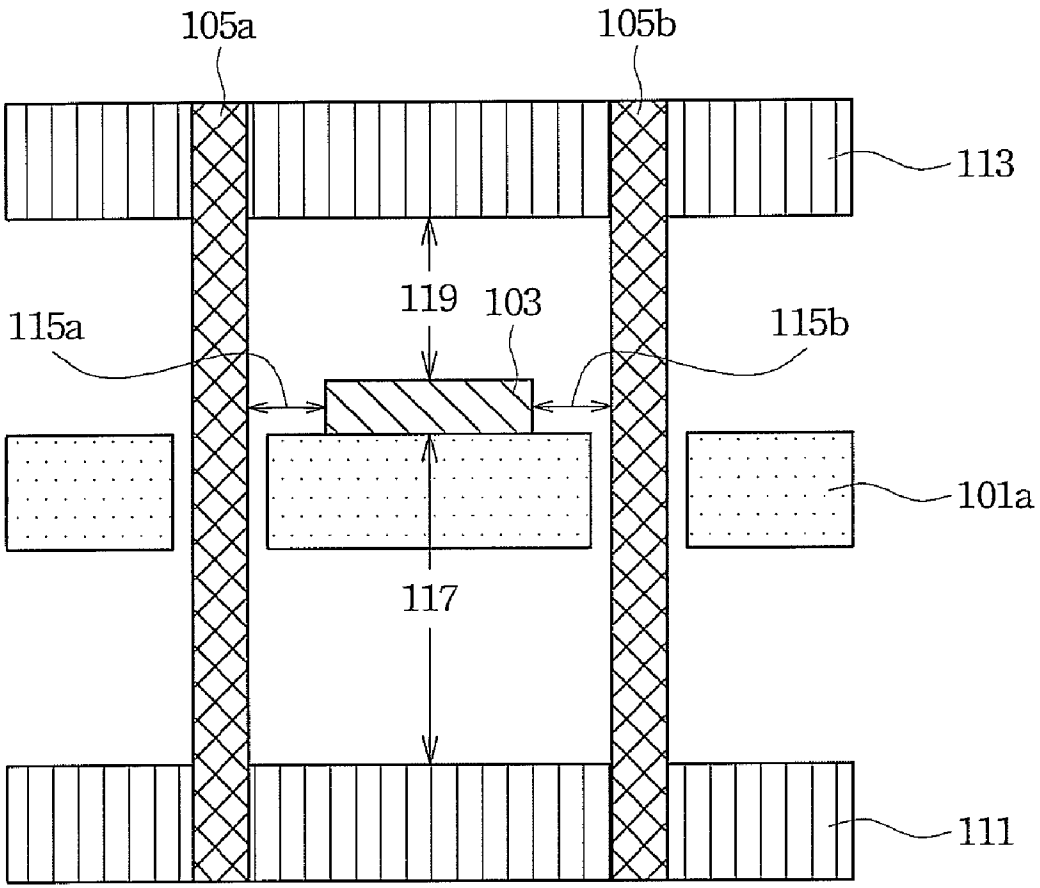
FIG. 1B shows the side view of the signal transmission structure according to one embodiment of the present invention.
Figure 1C:
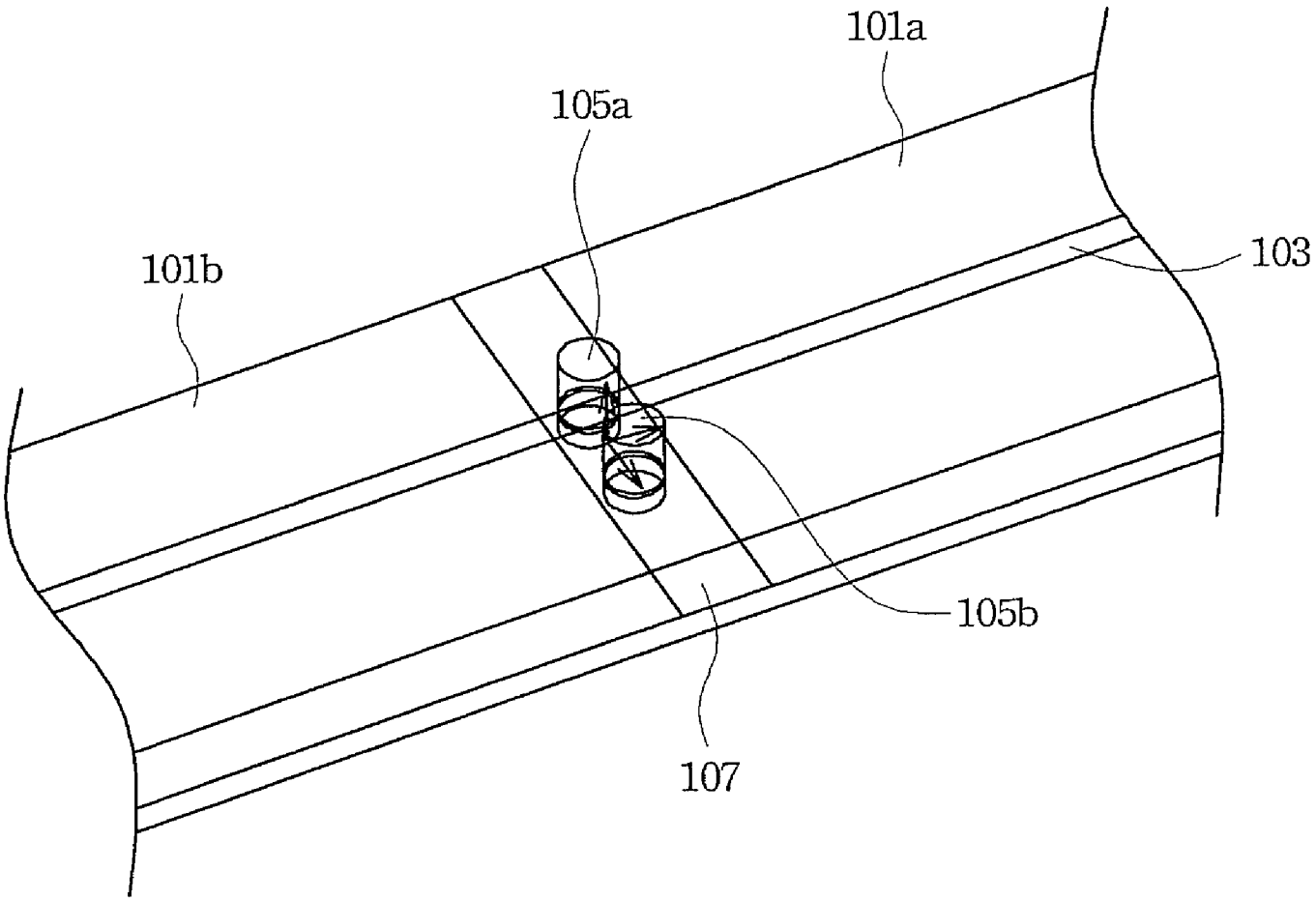
FIG. 1C shows the three dimensional view of the signal transmission structure according to one embodiment of the present invention.

FIG. 1A, FIG. 1B and FIG. 1C shows the top view, the side view and the three dimensional view of the signal transmission structure according to one embodiment of the present invention. The signal transmission structure includes power plane 101*a*, power plane 101*b*, the signal line 103, the pillar 105*a*, and the pillar 105*b*. The power plane 101*a* and the power plane 101*b*, implemented with printed circuit board, provide a first voltage and a second voltage respectively.

The interval space, such as slot 107, is disposed between the power plane 105*a* and 105*b*. The signal line 103 is disposed on first surfaces of the power planes 105*a* and 105*b*, and is across the interval space 107 vertically in order to reduce the effective inductance. The pillar 105*a* and the pillar 105*b*, are made of metal such as copper, aluminum, and stannum.

The pillar 105*a* and the pillar 105*b* are both disposed in the slot 107 and pass through the slot 107, and aside the signal line 103, in which the first pillar 105*a* and the second pillar are apart from the power planes 101*a*, the power plane 101*b*, and the signal line 103. The second pillar 105*b* is disposed opposite to the first pillar 105*a* with the signal line 103 interleaved.

As shown in FIG. 1B, the signal transmission structure further includes a first ground plane 111 and a second ground plane 113. While the signal line 103 is disposed on the first surface of the power plane 101*a*, the first ground plane 111 faces a second surface of the power plane 101*a*, and is electrically connected to the first pillar 105*a* and the second pillar 105*b*, in which the second surface is back to the first surface of the power planes 101*a*. The second ground plane 113 faces the first surface of the power plane 101*a*, and is electrically connected to the first pillar 105*a* and second pillar 105*b*, in which the signal line 103 is disposed between the second power ground 113 and the power plane 101*a*. Because the first pillar 105*a* and the second pillar 105*b* are electrically connected to the first ground plane 111 and second ground plane 113, the potential of the first pillar 105*a* and the second pillar 105*b* is ground potential.

Moreover, the signal line 103 can be disposed closer to the pillar 105*a*/105*b* than the first ground plane 111 during the layout process, that is, the distance (115*a*/115*b*) between the signal line 103 and the pillar 105*a*/105*b* is shorter than the distance (117/119) between the signal line 103 and the ground plane 111/113. The pillar 105*a*/105*b* can be implemented with vias.

Because the potential of pillar 105*a* and pillar 105*b* is equivalent to ground potential, which provides a short current return path for the signal line 103, thus the equivalent inductance and signal attenuation of high-frequency signals are reduced, and the high frequency signal is kept.

Figure 2A:
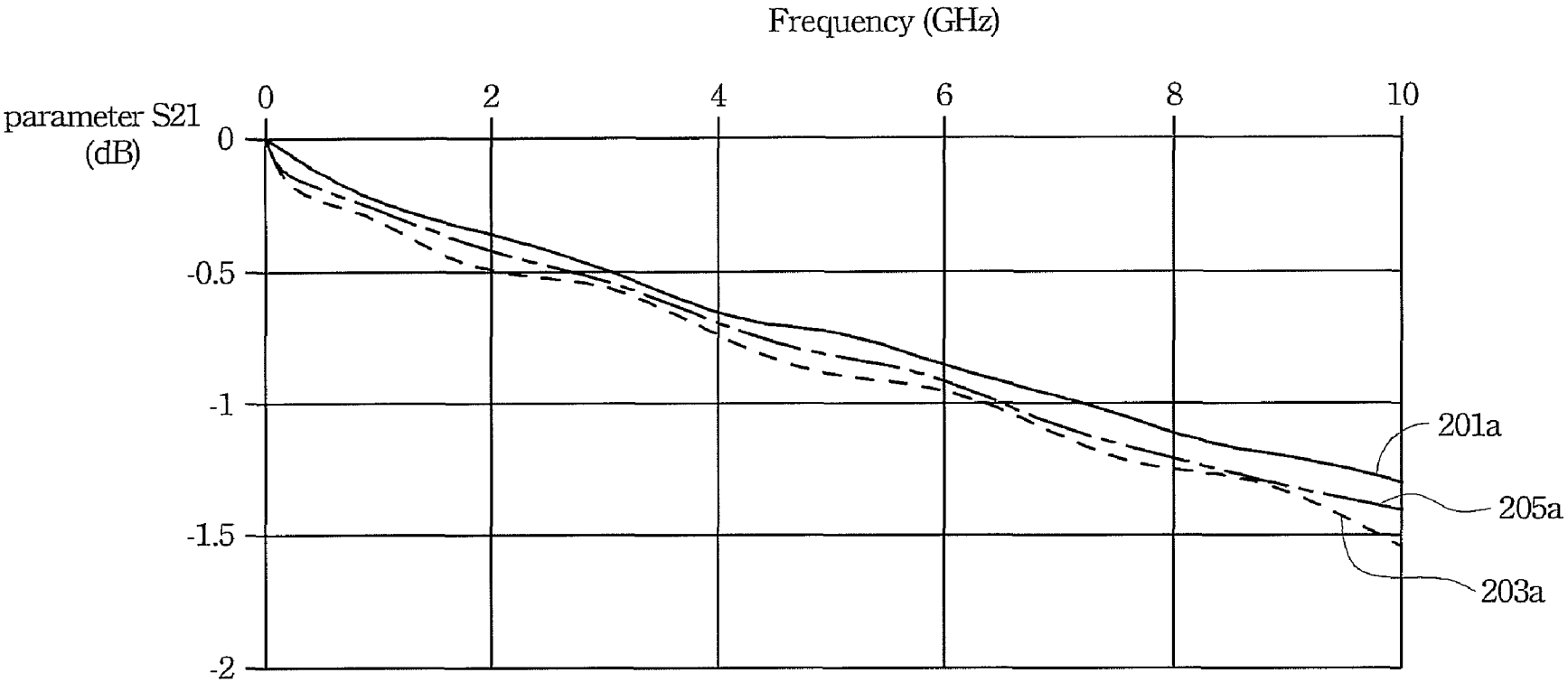
FIG. 2A shows the HFSS simulation result (S21 parameter) of the signal transmission structure according to one embodiment of the present invention.
Figure 2B:
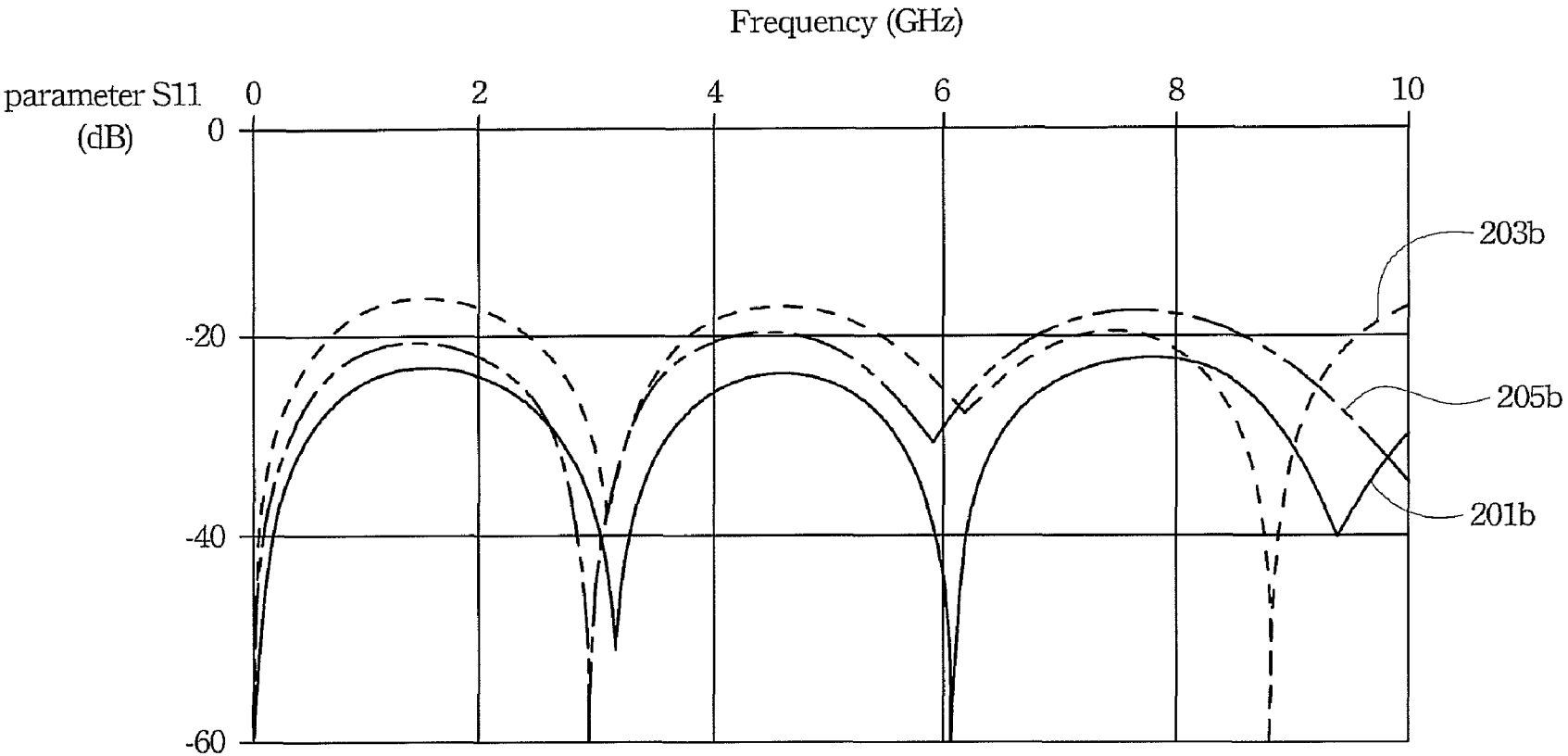
FIG. 2B shows the HFSS simulation result (S11 parameter) of the signal transmission structure according to one embodiment of the present invention.

FIG. 2A and FIG. 2B show the HFSS simulation result of the signal transmission structure according to one embodiment of the present invention, in which FIG. 2A shows the frequency domain of S21 parameter according to one embodiment of the present invention, and FIG. 2B shows the frequency domain of S11 parameter according to one embodiment of the present invention. The signal transmission structure simulated in this embodiment is one inch long, four millimeters wide (1 inch=1000 mils). In addition, the signal line, the power plane, and the ground plane are 1.2 millimeters thick. The dielectric constant (Er), the loss tangent, and the conductivity of the signal transmission structure are 4.2, 0.02, and 5.88e07 respectively. Curve 201*a*, 203*a*, 205*a* represent the S21 parameters simulation result of the complete power plane (without slot), the power plane with slot but without pillar, and the power plane with slot and pillar respectively; curve 201*b*, 203*b*, 205*b* represent the S11 parameters simulation result of the complete power plane (without slot), the power plane with slot but without pillar, and the power plane with slot and pillar, respectively.

According to curve 201*a*~205*a*, 201*b*~205*b* at frequency less than 6 GHz, the signal losses are reduced and the curves are smooth by disposing the pillar, and the high frequency signal is kept close to the original. In addition, the reflection parameter S11 is decreased, which means that the reflection phenomenon is reduced.

Figure 3A:
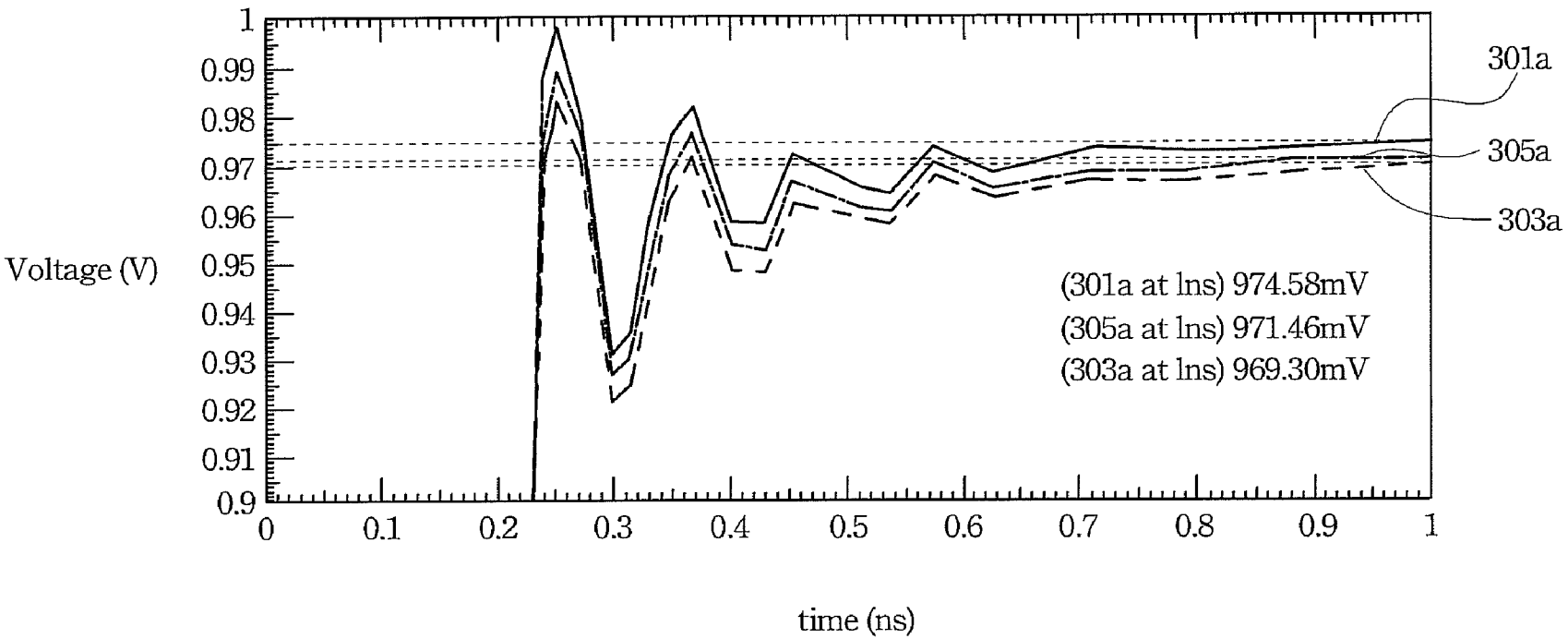
FIG. 3A shows the HSPICE simulation result of the signal transmission structure output end according to one embodiment of the present invention.
Figure 3B:
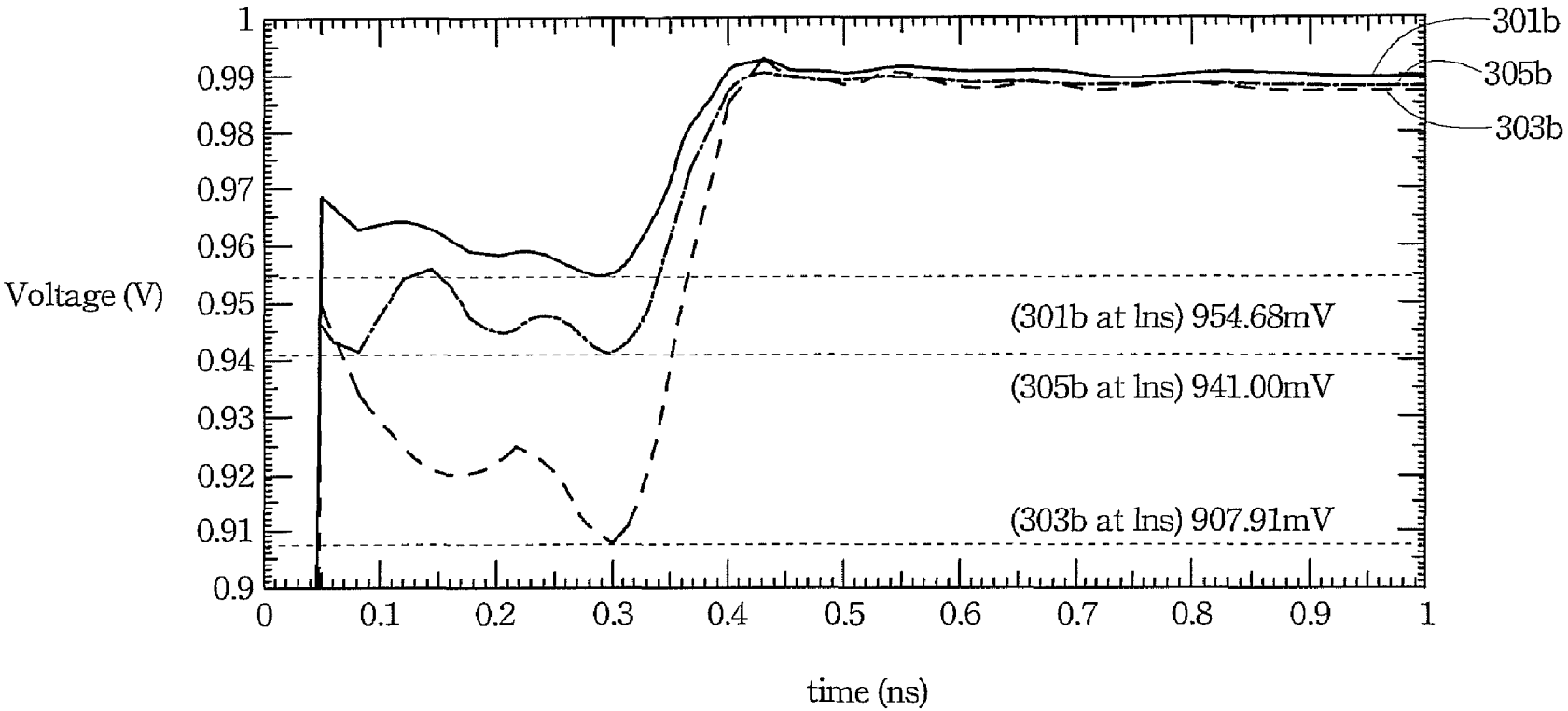
FIG. 3B shows the HSPICE simulation result of the signal transmission structure input end according to one embodiment of the present invention.

FIG. 3A and FIG. 3B show the HSPICE simulation result of the signal transmission structure according to one embodiment of the present invention, in which FIG. 3A and FIG. 3B show the time domain simulation result of output end and input end respectively. To verify the outcome of disposing the pillar, the S11, S21 parameter simulation result with HFSS software is inputted to the HSPICE simulation model, and step signal with 50 ps rise time and 2 v height is passed to the transmission structure.

In FIG. 3A, curve 301*a*, 303*a*, and, 305*a* represent the output end of the transmission structure of the complete power plane (without slot), the power plane with slot but without pillar, and the power plane with slot and pillar, respectively. From FIG. 3A, the signal loss of curve 305*a* (with pillar) is less than 303*a* (without pillar) at 1 ns, with 41% improvement ((971.46−969.30)/(974.58−969.30) =2.16/5.28=41%).

In FIG. 3B, curve 301*b*, 303*b*, and 305*b* represent the input end of the transmission structure of the complete power plane (without slot), the power plane with slot but without pillar, and the power plane with slot and pillar, respectively. As stated above, the reflection phenomenon which might damage the circuit is the one to be reduced.

In contrast to curve 303*b* (without pillar), the reflection of curve 305*b* (with pillar) is decreased about 30 mV. (The reflection is smaller as the voltage approach 1v). In this simulation, the original value of the input signal voltage (1000 mV) is the ideal target. Taking curve 301*b* (complete power plane without slot) as the compare base, curve 305*b* (with pillar) has improved about 77.36%. (1000−954.68=45.32 mV; 1000−941.00=59.00 mV; 1000−907.91=92.09 mV. The improvement is ((92.09−45.32)−(59.00−45.32))/(92.09−45.32)=33.09/46.77=77.36%)).

According to the above embodiments, by disposing the pillar within the slot, the length of the current return path is shorten, such that the inductance and the reflection effect of the high frequency signal are reduced, which reduces the signal loss caused by the slot on the power plane, and the signal can be kept as the original signal before transmitted.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A signal transmission structure, comprising:

two power planes providing a first voltage and a second voltage respectively, wherein an interval space is disposed between the power planes;

a signal line disposed on first surfaces of the power planes and across the interval space; and a first pillar disposed within the interval space and aside the signal line, wherein the first pillar is apart from the power planes and the signal line.

2. The signal transmission structure of claim 1, wherein the signal line is disposed vertically to the interval space.

3. The signal transmission structure of claim 1, wherein the first pillar is made of metal selected from the group consisting of copper, aluminum, and stannum.

4. The signal transmission structure of claim 1, wherein the power planes are printed circuit boards providing the first voltage and the second voltage respectively.

5. The signal transmission structure of claim 1, further comprising a first ground plane facing second surfaces of the power plane and electrically connected to the first pillar, wherein the second surfaces are back to the first surfaces of the power planes.

6. The signal transmission structure of claim 5, further comprising a second ground plane facing the first surfaces of the power plane and electrically connected to the first pillar, wherein the signal line is disposed between the second power ground and the power planes.

7. The signal transmission structure of claim 5, wherein the signal line is closer to the first pillar than the first ground plane.

8. The signal transmission structure of claim 5, further comprising a second pillar disposed in the interval space and electrically connected to the first ground plane, wherein the signal line is disposed between the second pillar and the first pillar.

9. A signal transmission structure, comprising:

a power plane;

a slot disposed on the power plane and dividing the power plane into two regions for providing two power signals;

a signal line disposed on a first surface of the power plane and across the slot;

a ground plane facing a second surface of the power plane; and a first pillar passing through the slot and electrically connected to the ground plane, wherein the first pillar is aside the power plane and apart from the signal line.

10. The signal transmission structure of claim 9, further comprising a second pillar disposed in the slot and electrically connected to the ground plane, wherein the second pillar is disposed opposite the first pillar with the signal line interleaved.

11. The signal transmission structure of claim 9, wherein the signal line crosses the slot vertically.

12. The signal transmission structure of claim 9, wherein the first pillar is made of copper, aluminum or stannum.

13. The signal transmission structure of claim 9, wherein the power plane and the ground plane are printed circuit boards.

14. The signal transmission structure of claim 9, wherein the distance between the signal line and the first pillar is shorter than the distance between the signal line and the ground plane.

15. The signal transmission structure of claim 14, wherein the ground plane faces the second surface back to the first surface of the power plane.

* * * * *